US007500806B2

(12) United States Patent
Higgins

(10) Patent No.: US 7,500,806 B2
(45) Date of Patent: Mar. 10, 2009

(54) METHOD AND APPARATUS FOR CONSTRUCTING FILTER ZONES IN EARTHFILL DAMS

(75) Inventor: Jeff L. Higgins, Bozeman, MT (US)

(73) Assignee: Barnard Construction Company, Inc., Bozeman, MT (US)

( * ) Notice: Subject to any disclaimer, the term of this patent is extended or adjusted under 35 U.S.C. 154(b) by 323 days.

(21) Appl. No.: 10/957,052

(22) Filed: Oct. 1, 2004

(65) Prior Publication Data

US 2006/0013655 A1 Jan. 19, 2006

Related U.S. Application Data

(60) Provisional application No. 60/584,735, filed on Jun. 30, 2004.

(51) Int. Cl.
*E02B 7/06* (2006.01)

(52) U.S. Cl. ..... 405/117; 405/270; 405/271; 404/110; 209/910

(58) Field of Classification Search ..... 405/116, 405/117, 270, 271; 172/111; 404/108, 110, 404/101, 105; 209/478, 488, 494, 910
See application file for complete search history.

(56) References Cited

U.S. PATENT DOCUMENTS

| | | | | |
|---|---|---|---|---|
| 3,429,130 | A * | 2/1969 | Feiner et al. | 405/116 |
| 3,909,146 | A * | 9/1975 | Hoffman | 404/110 |
| 4,508,471 | A * | 4/1985 | Mulders et al. | 405/109 |
| 4,657,431 | A * | 4/1987 | Morrison | 404/108 |
| 5,335,828 | A * | 8/1994 | Kaiju et al. | 222/195 |

* cited by examiner

*Primary Examiner*—Tara L. Mayo
(74) *Attorney, Agent, or Firm*—Todd N. Hathaway

(57) ABSTRACT

A method and apparatus for constructing a filter zone of an earthfill dam, in which the filter zone includes adjacent coarse and fine filter layers. The coarse and fine filter materials are discharged simultaneously from an earthmoving vehicle having an ejector body. The ejector body includes a longitudinal divider wall that maintains segregation of the materials during transport, and the materials are discharged through separate chute assemblies so as to place the materials in elongate, side-by-side berms. The ejector vehicle is followed by a dozer or other piece of equipment that grades both berms simultaneously. Each pass of the ejector vehicle and dozer thus forms a stratum of the filter zone. The passes are repeated to form a plurality of strata in overlying relationship such that the coarse particulate material forms the coarse filter portion of the filter zone and the fine material forms the fine filter portion of the zone.

22 Claims, 8 Drawing Sheets

110
12
12
100
108
106a
102
104
11
11
96
34
56
30

100
108
102
106a
106b
104
98
94
96
34
54
56
20

112
116
98
118
114

94
98
96

METHOD AND APPARATUS FOR CONSTRUCTING FILTER ZONES IN EARTHFILL DAMS

RELATED APPLICATIONS

This application claims the benefit of U.S. Provisional Patent Application No. 60/584,735 filed on 30 Jun. 2004.

BACKGROUND a. Field of the Invention

The present invention relates generally to methods and apparatus for construction of earthfill dams and, more particularly, to a method and apparatus for constructing the internal filter zones of earthfill dams by depositing and working the fine and coarse materials that form the filter zones on a simultaneous basis rather than separately.

b. Related Art

In the past, earthfill dams were constructed as a more or less homogenous mass of earth, excavated from a suitable borrow area near the construction site. Modern earthfill dams are rather more complex structures having a number of features that have been adopted both to increase the longevity of the dam and to prevent the failure, sometimes catastrophic, to which earlier earthfill dams were sometimes subject.

One particular feature of modern earthfill dams is the inclusion of filter zones, typically on both the upstream and downstream sides of the core. For example, FIG. 13 provides a simplified view of an earthfill dam 10 having a core 12 flanked by upstream and downstream filter zones 14, 16. Seepage flow passes through the filter zones and is collected by drains so as to be conveyed out of and away from the dam structure, e.g. through a blanket drain 18 as shown in FIG. 13.

The coarse and fine layers 20, 21 of the filter zones cooperate to prevent migration of soil particles while still providing for passage of the seepage flow. In this manner, the seepage is collected and permitted to drain freely, but piping (removal) of soil/fill particles from the dam (which might cause serious damage or even complete failure) is prevented. The coarse and fine filter materials may be, for example, crushed rock and sand, and are covered by additional fill that forms the main berm 24 of the dam.

In order to effectively intercept seepage flow, the filter zones extend upwardly over substantially the full height of the dam, generally vertically or at a steep angle as shown in FIG. 13. Consequently, the filter zones cannot be made by simply placing two layers sequentially one on top of the other, but instead must be built up vertically next to one another, usually simultaneous with the construction of other parts of the dam, e.g., the berm/shell. Conventionally, this has been done by first depositing a load of one of the materials (e.g., the coarse material) in a narrow row and compacting it, then bringing in and depositing a separate load of the second (e.g., fine) material and repeating the process alongside the first row, with the sequence being repeated over and over as the dam is built up to its full height.

The conventional method of constructing filter zones is thus laborious and inefficient. Furthermore, it is difficult to deposit, arrange and compact the two separate materials with the required degree of accuracy. In most instances, the two layers of the filter zones are only a few feet (e.g., 3-8 feet) thick, so that working them requires a degree of accuracy and finesse that is difficult to achieve with conventional earthmoving machinery. Moreover, depositing and working the two layers of material next to one another on an alternating basis tends to cause an undesirable degree of mixing to occur at the interface where the materials meet.

Consequently, the conventional methods and apparatus used to construct the filter zones are laborious and add significantly to the cost of constructing a typical earthfill dam. Moreover, the conventional methods and techniques are difficult and prone to errors that can, in some cases, be extremely expensive to rectify.

Accordingly, there exists a need for a method and apparatus for constructing the filter zones of earthfill dams that does not require the adjoining layers of coarse and fine fill material to be deposited and worked on a separate basis. Furthermore, there exists a need for such method and apparatus that enables the filter zones to be constructing rapidly and efficiently with reduced likelihood of error. Still further, there exists a need for such a method and apparatus that uses economical systems and that is compatible with other forms of earthmoving equipment that are employed on earthfill dam construction projects.

SUMMARY OF THE INVENTION

The present invention has solved the problems cited above, and provides a method for constructing the filter zone of an earthfill dam. Broadly, the method comprises the steps of: (a) placing first and second relatively coarser and relatively finer particulate materials in a vehicle so that the first and second materials remain segregated therein; (b) advancing the vehicle along a predetermined path that corresponds to a horizontal cross-section of the filter zone while discharging the particulate materials therefrom, so that in a single pass the first, relatively coarser particulate material and the second, relatively finer particulate material are deposited simultaneously in adjoining relationship generally on first and second sides of the path so as to form a stratum of the filter zone; and (c) repeating of the step of advancing the vehicle along the predetermined path while discharging the particulate materials, so as to form a plurality of the strata in built-up, overlying relationship such that the relatively coarser particulate material forms a coarse filter portion of the filter zone and the relatively finer particulate material forms a fine filter portion of the filter zone.

The step of discharging the particulate materials may comprise depositing the first and second particulate materials in elongate berms that meet along a common interface. The method may further comprise the step of grading the elongate berms of each stratum prior to depositing a subsequent stratum thereon. The step of grading the elongate berms may comprise at least partially compacting the particulate materials of the stratum prior to depositing the subsequent stratum thereon.

The step of discharging the particulate materials may comprise discharging the first and second particulate materials from an ejector body on the vehicle, the ejector body having a divider that maintains segregation of the particulate materials during transportation and discharge, and the step of grading the elongate berms may comprise grading the berms with a second vehicle that trails the first along the predetermined path. The step of grading said elongate berms may further comprise compacting the berms with a third vehicle that trails said second vehicle along said predetermined path.

The vehicle having the ejector body may be an earthmoving truck, and the step of grading the berms may further comprise grading the berms so that the stratum has a substantially level upper surface for subsequent passage of the earthmoving truck thereover. The second vehicle trailing the truck may be a dozer having a blade for levelling the berms of particulate material. The step of grading the elongate berms may further comprise compacting the berms with a roller compactor that trails the dozer along the predetermined path.

In a preferred embodiment, the invention provides a method that comprises the steps of: (a) placing the first and second relatively coarser and relatively finer materials in a truck having a load body with longitudinal barrier that segregates the first and second particulate materials on opposite sides of the truck; (b) advancing the truck along a predetermined path that corresponds to a horizontal cross-section of the filter zone while ejecting the first and second particulate materials rearwardly from the load body, so that in a single pass the first, relatively coarser particulate material and the second, relatively finer particulate material are deposited simultaneously in adjoining elongate berms generally on first and second sides of the path so as to form a stratum of the filter zone; (c) grading the elongate berms of the first and second particulate materials with a dozer that trails the truck along the predetermined path, so as to at least partially compact the particulate materials and form a generally level upper surface on the stratum; and (d) repeating sequentially the steps of advancing the truck along the predetermined path while ejecting the particulate materials and grading the berms with the dozer trailing the truck, so as to form a plurality of the strata in built-up, overlying relationship such that the relatively coarser particulate material forms a coarse filter portion of the filter zone and the relatively finer particulate material forms a fine filter portion of the filter zone.

The present invention also provides an apparatus for constructing a filter zone of an earthfill dam, the apparatus comprising: (a) a vehicle; and (b) a load body mounted to the vehicle for transporting the first and second relatively coarser and relatively finer particulate materials and discharging the materials therefrom, the load body comprising: (i) a load box having an interior for retaining the particulate materials; (ii) an ejector assembly mounted in the load box for discharging the particulate materials therefrom, the ejector assembly comprising: a forward bulkhead that extends generally transversely across the interior of the load box; a divider bulkhead that extends from the forward bulkhead generally longitudinally through the interior of the load box so as to maintain segregation of the first and second particulate materials therein; and means for translating the forward bulkhead rearwardly through the load box so as to discharge the particulate materials from a rearward end thereof; and (iii) a chute assembly mounted proximate the rearward end of the load box, the chute assembly comprising: first and second generally downwardly-directed chutes for receiving separately the first and second particulate materials that are discharged from the load box and directing the materials downwardly as the vehicle is driven forwardly so as to deposit the materials in first and second elongate berms that form a stratum of the filter zone.

The divider bulkhead of the ejector assembly may comprise a generally planar divider wall that separates the load box into right and left compartments. The divider wall may extend substantially along a centerline of the load box so as to divide the load box into substantially equal-sized compartments. The divider wall may comprise an upper edge portion that extends to a level above first and second outboard edges of the load box, so that the divider wall forms a backstop that prevents material from spilling from one of the compartments to the other while being loaded. The ejector assembly may further comprise a rearward bulkhead that is mounted to a rearward portion of the divider wall and extends generally transversely across the interior of the load box, so that when the ejector assembly is in a forward, retracted position the rearward bulkhead closes the rearward end of the load box and when the ejector assembly is translated rearwardly towards an extended position the rearward bulkhead opens the rearward end of the load box so as to permit the particulate materials to be discharged therefrom.

The ejector assembly may further comprise means for supporting a rearward portion of the divider bulkhead as the forward bulkhead is translated rearwardly through the load box. The means for supporting a rearward portion of the divider bulkhead may comprise a horizontal axis roller mounted in supporting engagement with a lower edge of the divider wall.

The chute assembly may comprise first and second deflector portions that direct the first and second particulate materials in downward and inward directions so that the first and second elongate berms meet along a common interface. The chute assembly may further comprise means for substantially preventing mixing of the first and second particulate materials at the common interface between the elongate berms. The means for preventing mixing of the first and second particulate materials may comprise a divider plate that extends generally vertically intermediate the first and second deflector portions in substantially coplanar relationship with the divider wall of the ejector assembly.

These and other features are advantages of the present invention will be more fully understood from a reading from the following detailed description with reference to the accompanying drawings.

DETAILED DESCRIPTION

As will be described in greater detail below, the present invention provides a method in which the coarse and fine fill materials that form the filter zones are deposited simultaneously and then graded and compacted in a single pass. The materials are deposited from an earthmoving ejector truck having a divider and chutes that maintain segregation of the materials during their transport and discharge. Both materials are then graded and compacted by following earth working equipment.

Because only a single pass is required to deposit both materials, placement is much quicker and more efficient than with conventional techniques. Moreover, the working of the material after it has been deposited is greatly simplified and reduced as compared with prior methods. The present invention consequently permits significant savings to be achieved on many or most earthfill dam projects.

As used in this description and the appended claims, the term "earthfill dam" includes all dams (including those sometimes referred to as "earth dams" or "berm dams") that are built up by compacting successive layers of material. Moreover, the term "truck" as used in this description and the appended claims includes all vehicles or conveyances for transporting the fill materials to the site, and the term "dozer" includes all forms of equipment capable of grading the fill material.

Figure 1:
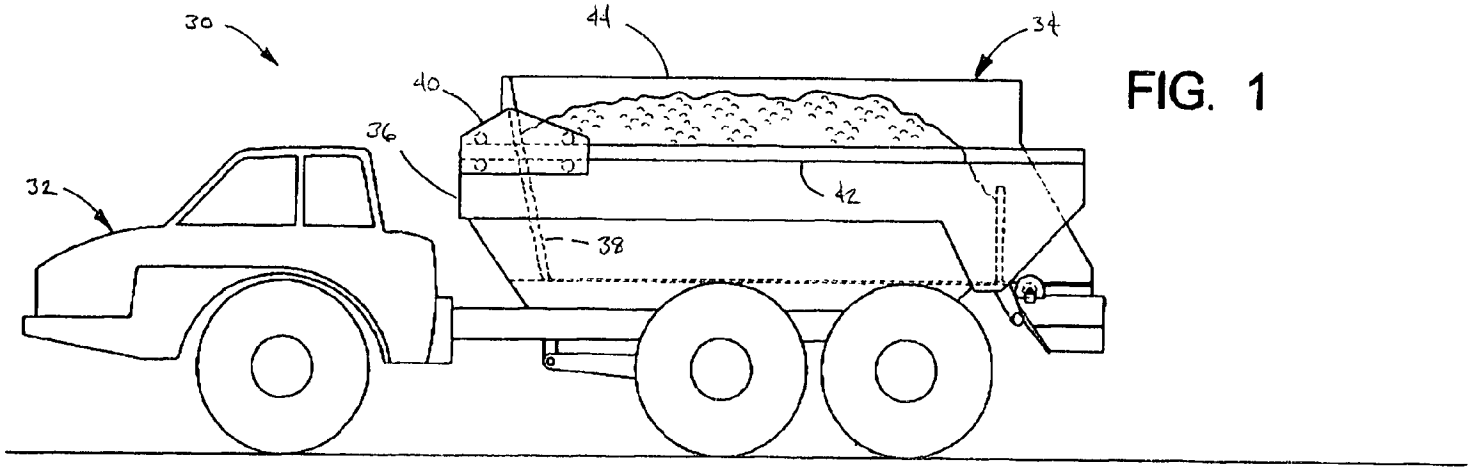
FIG. 1 is a first elevational view of an earthmoving truck fitted with a divided ejector body for simultaneously discharging the coarse and fine materials that form the filter zones of an earthfill darn.
Figure 2:
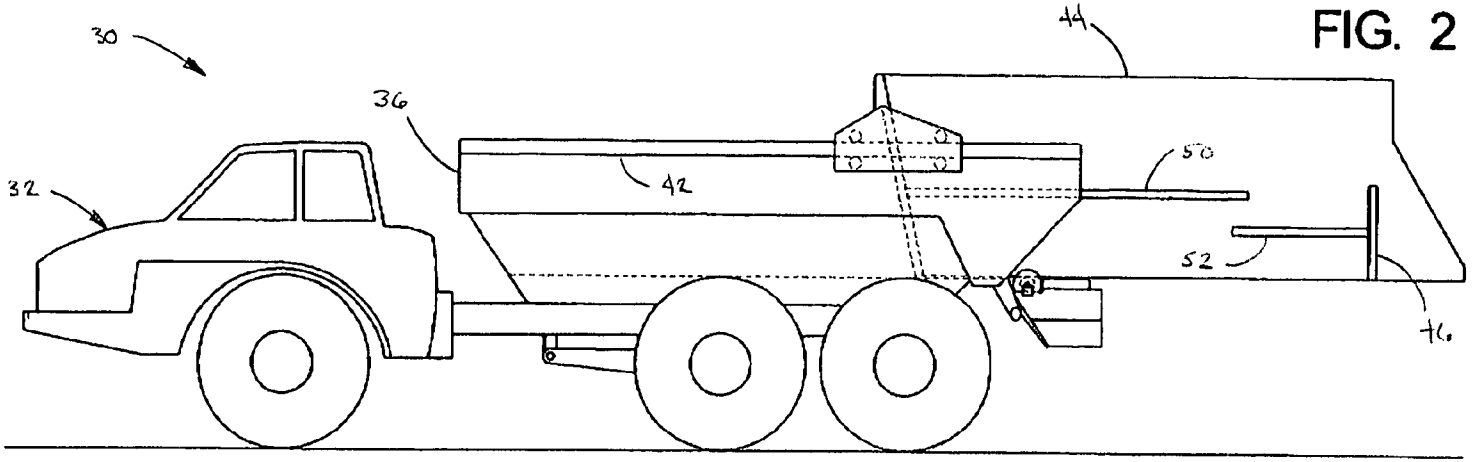
FIG. 2 is a second elevational view of the earthmoving truck of FIG. 1, showing the ejector body thereof having been moved to an extended position in which the coarse and fine fill materials are discharged therefrom.

Accordingly, FIG. 1 shows an ejector truck 30 that includes a generally conventional earthmoving truck 32 having an ejector body 34 mounted thereon. The ejector body includes a load-carrying box 36 that houses a transverse, moving bulkhead 38 that is driven fore-and-aft through the box by a hydraulic ram (not shown). The lateral ledges of the bulkhead are supported by guide assemblies 40 that engage longitudinal rails 42 along the upper edges of the box. Actuating the ram thus forces the bulkhead 38 longitudinally through the box, ejecting the load from the rearward end thereof. An example of an ejector truck having the basic features described in this paragraph is the Caterpillar Model 740 ejector truck.

Figure 5:
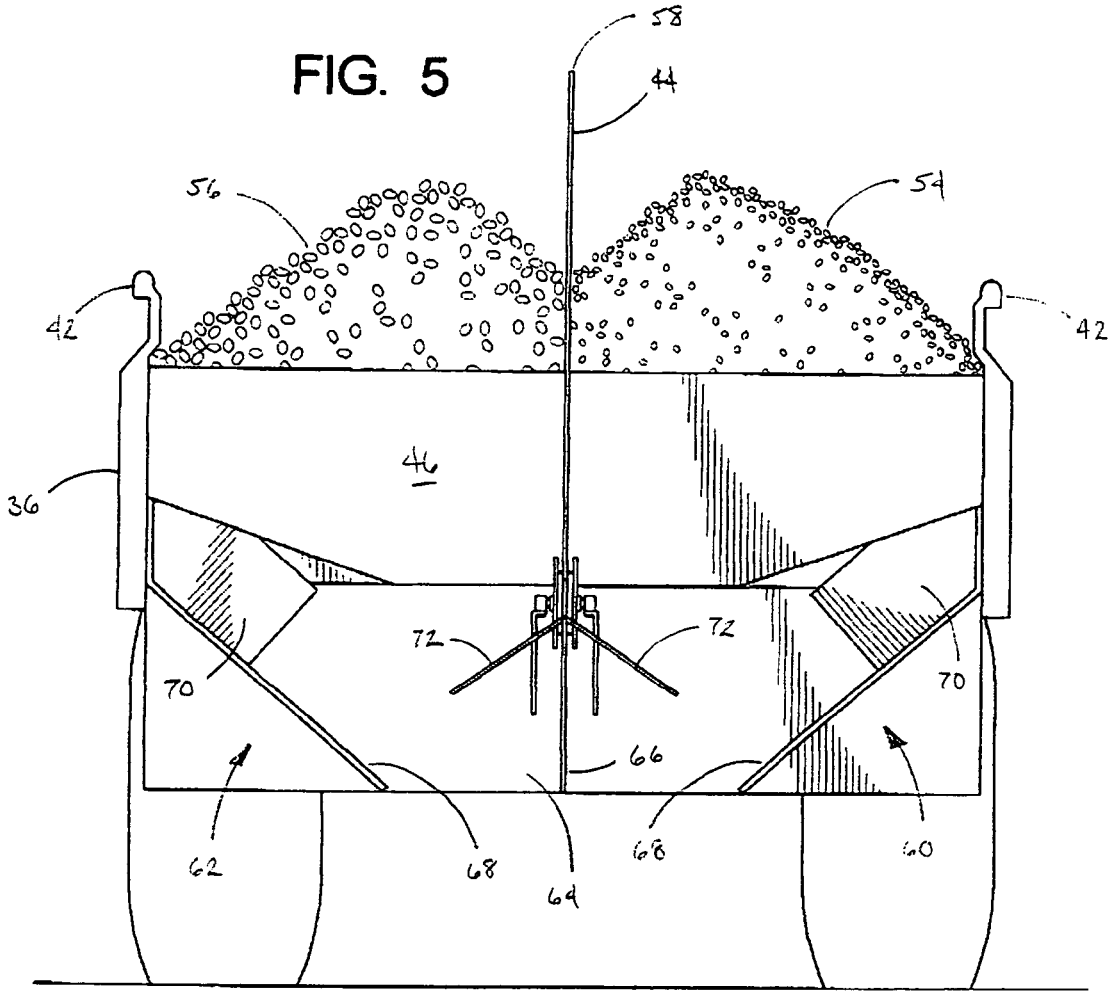
FIG. 5 is a rear, elevational view of the earthmoving truck of FIGS. 1-2, showing the manner in which the central divider of the bed maintains segregation of the coarse and fine fill materials, and also the arrangement of the discharge chutes at the rear of the ejector assembly.

In accordance with the present invention, the ejector assembly further includes a wall 44 that extends the full length of the box, with the rearward end of the box being closed by a rear bulkhead 46. As can be seen in FIG. 5, wall 44 forms a longitudinally extending divider that separates the load box into left and right sides, one for holding the finer grade fill material 54 and the other holding the coarser fill material 56 (the drawings show the finer material on the right side and the coarser material on the left, however, it will be understood that this may be reversed). The upper edge of 58 of the divider wall extends to a height significantly above the level of the guide rails 42 along the sides of the box, thus forming a backstop that allows the box to be filled rapidly from the sides (e.g., by loaders) without fear of mixing the materials.

The embodiment that is illustrated has a divider wall that extends along the longitudinal centerline of the truck, thus dividing the load-carrying box into two equal-sized compartments. It will be understood, however, that in some embodiments, the divider wall may be offset to one side or the other (and the respective discharge chutes configured/sized accordingly), based on differing fill materials, differing widths of the filter layers, and other design factors. Moreover, in some embodiments there may be two or more dividers that separate the box into additional compartments so as to be able to place additional layers of filter material.

Figure 3:
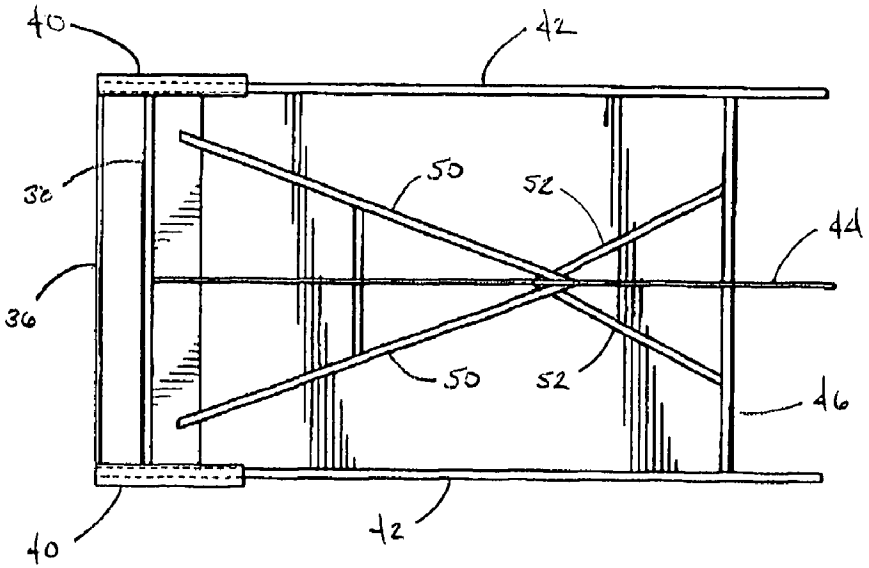
FIGS. 3 and 4 are top, plan views of the ejector body of the earthmoving truck of FIGS. 1-2, showing, respectively, the body in the retracted and extended positions.
Figure 4:
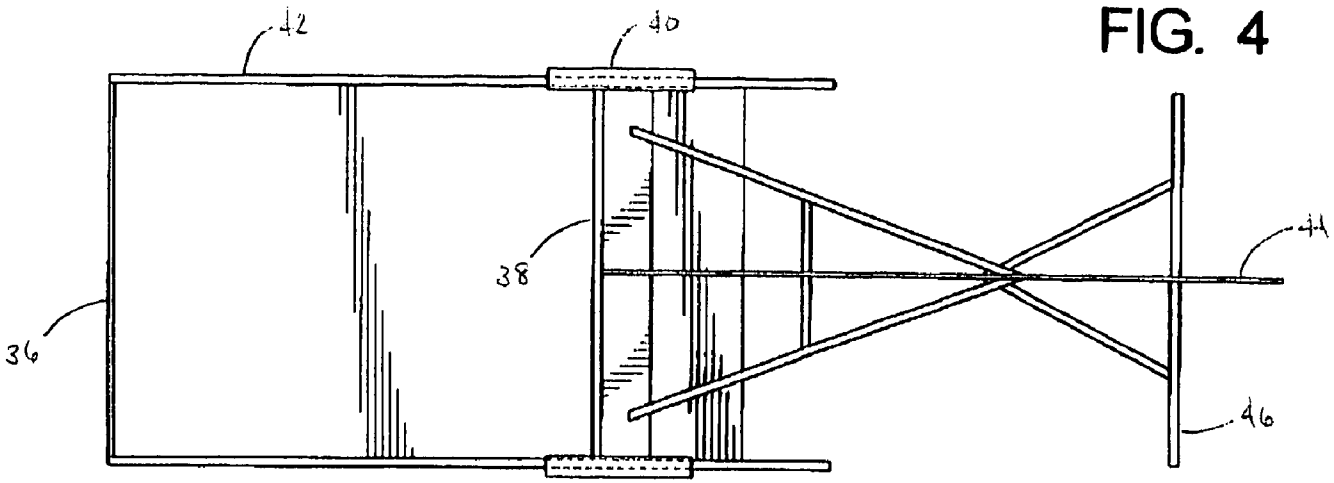

As noted above, the divider wall 44 is mounted to and extends rearwardly from the forward bulkhead 38 of the ejector assembly, and the rearward bulkhead 46 is in turn mounted across the rearward end of the divider wall. For increased strength, the forward and rearward bulkheads 38, 46 are interconnected with the centerline divider wall 44 by angled struts 50, 52, as shown in FIGS. 3 and 4. As can also be seen in FIGS. 3-4, both bulkheads extend the full width of the load box 36, so that when the assembly is in the retracted position (see FIG. 3) the rearward end of the box is closed by the rear bulkhead 46, thus retaining the fill materials within the box during transport.

In order to discharge the materials from the box, the hydraulic ram (not shown) is actuated to move the ejector assembly rearwardly at a controlled rate. As this is done, the rear bulkhead moves outwardly and opens from the rearward end of the box 36, so that the fine and coarse fill materials are discharged rearwardly and downwardly through their respective chute assemblies 60, 62.

Figure 7:
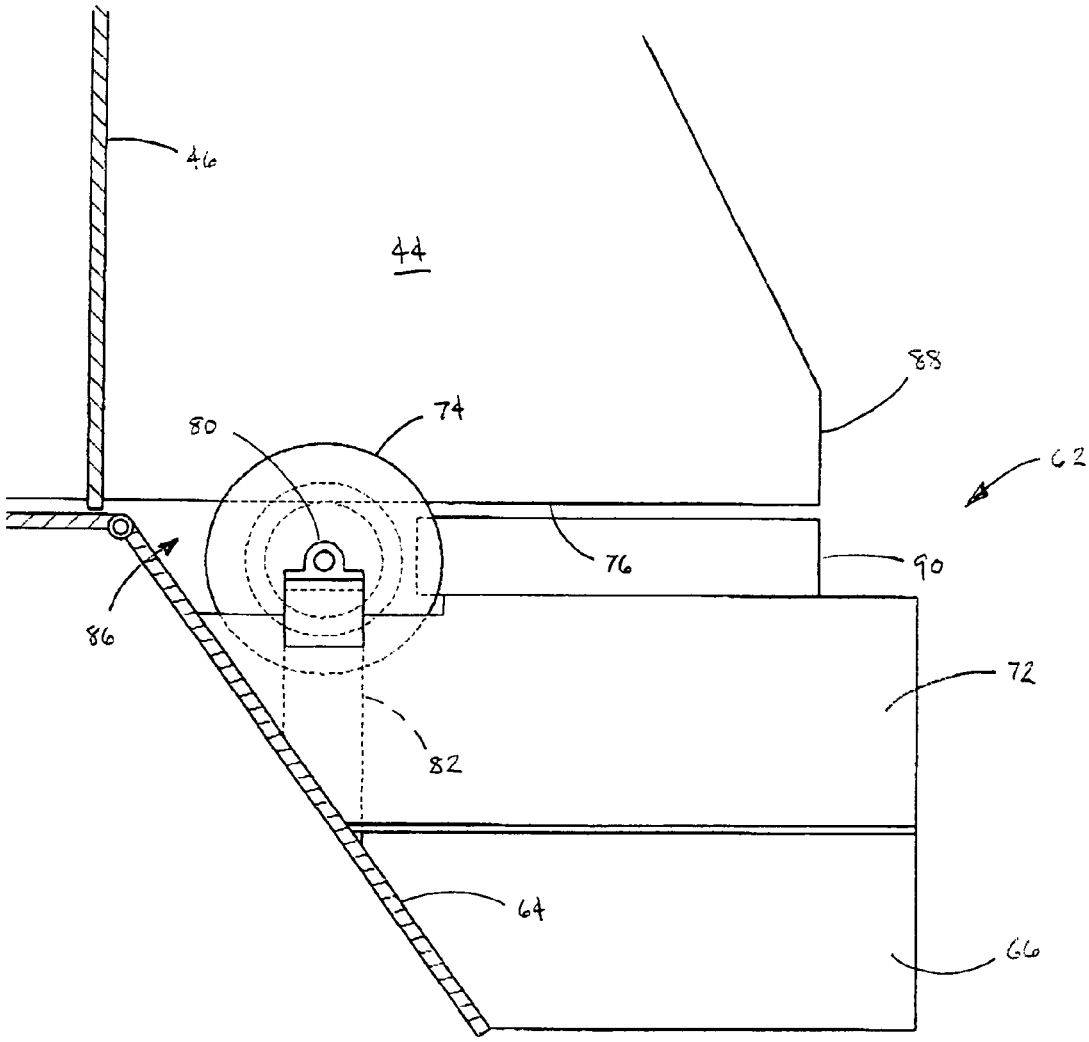
FIG. 7 is a cross-sectional view, taken along the center-line of the ejector body of FIGS. 5-6, showing the configuration of the chutes in greater detail and also the manner in which the ejector bed divider is supported by a roller as the assembly is moved between extended and retracted positions.

As can be seen in FIGS. 5 and 7, the chute assemblies are defined by a downwardly and rearwardly angled skirt plate 64, which is bisected by a vertical, center-line divider plate 66 that extends in coplanar relationship with the main divider wall 44. Downwardly and inwardly angled deflector plates 68 at the outboard sides of the chute assemblies direct the fill materials inwardly towards the centerline of the vehicle. Upwardly extending guide plates 70 are mounted along the upper edges of the deflector plates to block the direct rearward path of the materials, so that the materials are redirected and pass downwardly onto the deflector plates. Smaller, secondary deflector plates 72 are mounted proximate the central divider plate 66 and extend at downward and outward angles, thus cooperating with the outboard deflector plates 68 to define a somewhat V-shaped discharge path.

Figure 8:
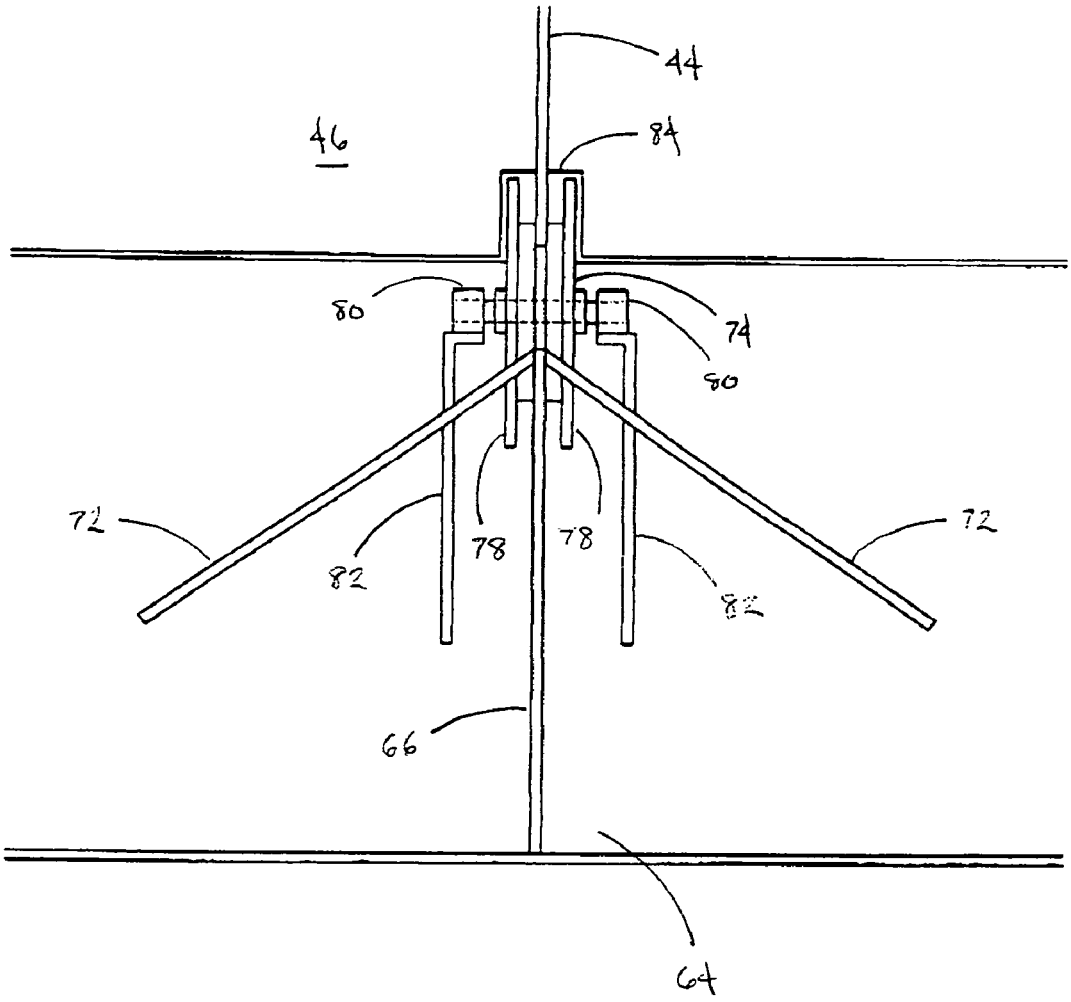
FIG. 8 is a partial, end elevational view of the ejector body assembly of FIGS. 5-6, showing the relationship between the support roller and the bed divider in greater detail.

As can be seen in FIGS. 7 and 8, the chute assembly also includes a centerline-mounted, horizontal axis tail roller 74 that engages the lower edge 76 of the divider wall 44 so as to support the ejector assembly as it moves rearwardly to its extended position. The roller includes first and second radial flanges 78 that limit side-to-side movement of the divider wall 44, and is supporting in bearings 80 that are mounted atop brackets 82 that extend upwardly from the skirt plate 64. As can be seen in FIG. 8, a small notch 84 is formed at the base of the rear bulkhead 46 to permit the latter to pass over the support roller without obstruction. Vertical and fore-and-aft clearance for the roller is in turn provided by a gap 86 at the top of the divider plate 66, with the space between the divider plate and the trailing edge 88 of the divider wall being filled by a short vertical extension 90.

Figure 6:
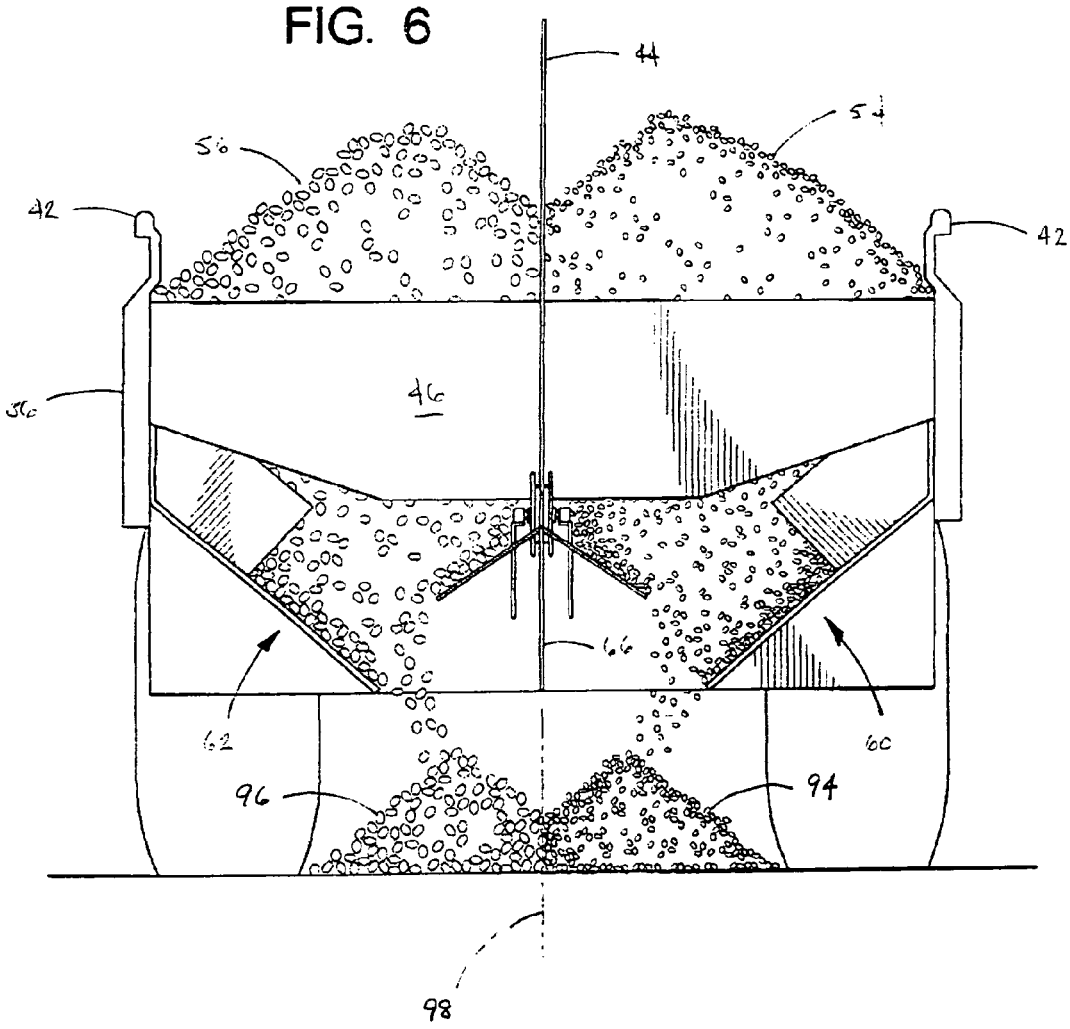
FIG. 6 is a rear, elevational view of the earthmoving truck of FIGS. 1-2, similar to FIG. 5, showing the manner in which the chutes at the rear of the ejector assembly direct coarse and fine fill materials as the materials are discharged from the ejector body.

As can be seen in FIG. 6, the components of the chute assemblies cooperate to direct the discharged fill materials into adjoining piles while maintaining separation between the materials and preventing any significant intermixing. The truck is driven forwardly as the ejector body discharges the fill materials, so that the materials form elongate piles or berms 94, 96 that meet along an interface 98 that generally follows the plane of the central divider plate 66.

In accordance with the method of the present invention, truck 30 is driven at a controlled rate along a predetermined path that corresponds to a horizontal cross-section of the filter zone, while at the same time discharging the filter materials so that the two elongate berms 94, 96 are formed in the manner described above. The truck is trailed along the path, either immediately or at a later time, by a dozer 100 or other piece of earth-moving equipment suitable for striking off/grading the fill material.

Figure 9:
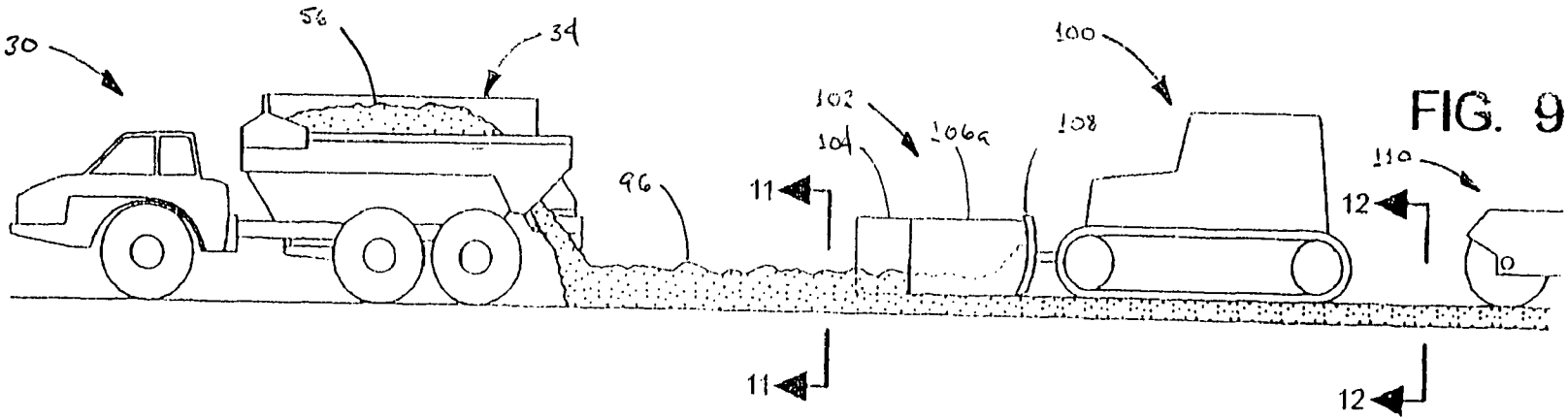
FIGS. 9 and 10 are, respectively, elevational and plan environmental views showing the manner in which the coarse and fine fill materials are simultaneously discharged from the earthmoving truck and then struck off and compacted by following equipment, in accordance with the method of the present invention.
Figure 10:
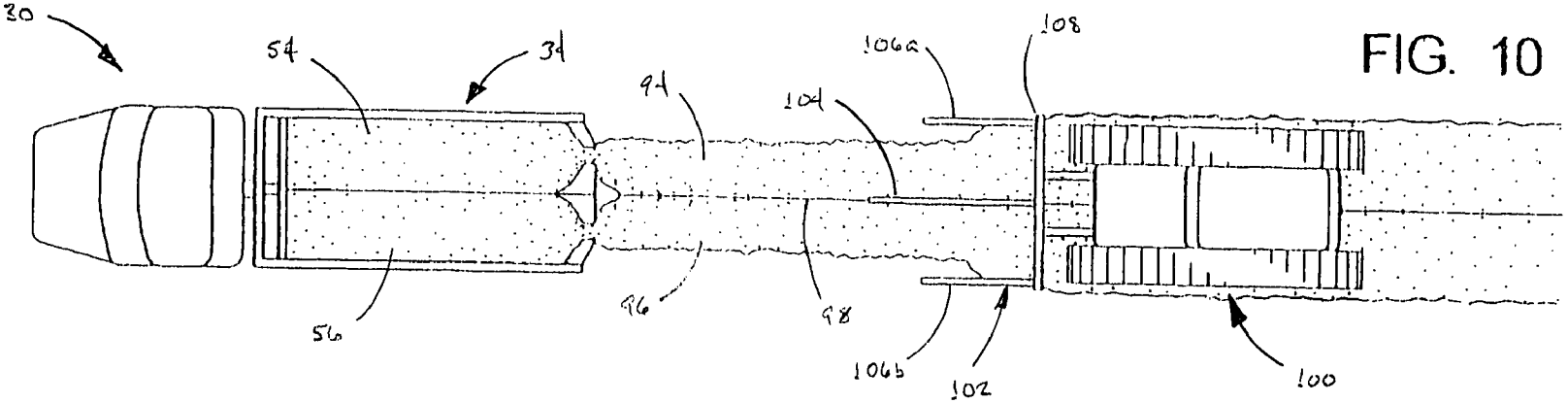

As can be seen in FIGS. 9-10, the dozer is equipped with a blade assembly 112 that levels the two berms and spreads them to a width that corresponds to the horizontal width of the completed filter zone. The blade assembly preferably includes a central, forwardly projecting divider plate 104 that is flanked by right and left side plates 106*a*, 106*b*. As can be seen in FIG. 10, the divider and side plates extend in a forward direction perpendicular to a conventionally-shaped strike-off blade 108, with the side plates being somewhat shorter than the central divider plate and being spaced outwardly so as to form spaced gaps on either side of the divider plate.

When following the ejector truck as shown in FIGS. 9-10, the operator maintains the divider plate 104 of the blade assembly 102 in line with the interface 98 between the two berms of fill material. In doing so, the upper edge of the divider plate provides a visual guide that aids the operator in maintaining proper alignment of the blade assembly with respect to the berms. The divider plate 104 therefore maintains separation of the coarse and fine fill materials as the adjoining berms are engaged and graded by the strike-off blade 108. The sidewalls 106*a*, 106*b*, in turn, retain the materials against spreading outwardly as they are graded and leveled, the spacing between the sidewalls being approximately equal to the intended width of the filter zone, thus minimizing wastage of the comparatively expensive filter materials.

Passage of the dozer over the struck-off berms compacts the fill materials to a certain extent. In installations where additional compaction is called for, the dozer can be followed by a roller compactor 110 or other suitable piece of equipment, as shown in FIG. 9. Moreover, it will be understood that in some embodiments a single vehicle may be utilized to both deposit and grade the fill materials (and possibly compact them as well), rather than using a separate truck and dozer or other equipment as shown.

Figure 12:
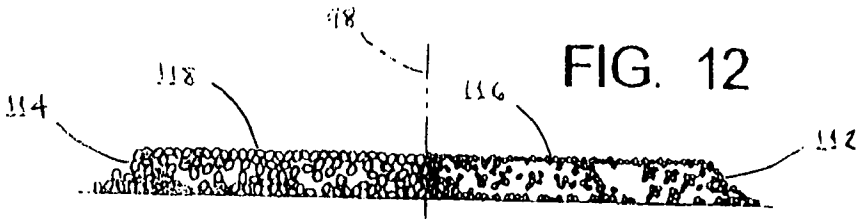
FIG. 12 is a second cross-sectional view, taken along line 12-12 in FIG. 9, showing the relationship between the berms of coarse and fine fill materials after these have been struck off and compacted and showing the manner in which the boundary defining the interface between the two is maintained with minimal mixing of the materials.
Figure 11:
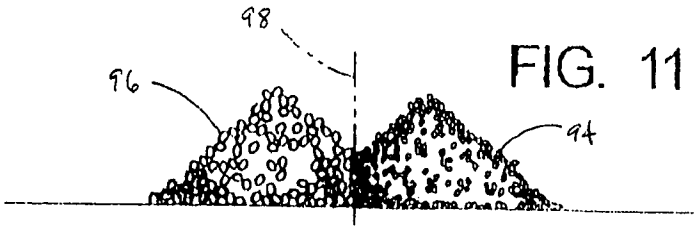
FIG. 11 is a cross-sectional view, taken along line 11-11 in FIG. 9, showing the relationship between the two, parallel berms of coarse and fine fill material as these are initially discharged from the ejector body of the earthmoving truck.

As can be seen by comparison of FIGS. 11 and 12, passage of the dozer (and roller, where used) spreads and compacts the berms so these form more-or-less equal height, side-by-side layers 112, 114 in a single stratum of the filter zone. Moreover, the upper surfaces 116, 118 of the two layers are levelled to a substantially common plane; this in essence provides a "roadway" over which the truck and dozer can be driven relatively quickly during the next pass, depositing and compacting another, substantially identical stratum atop the first. The process is repeated, with the rows of fine and coarse material placed in vertical alignment with their predecessors.

Figure 13:
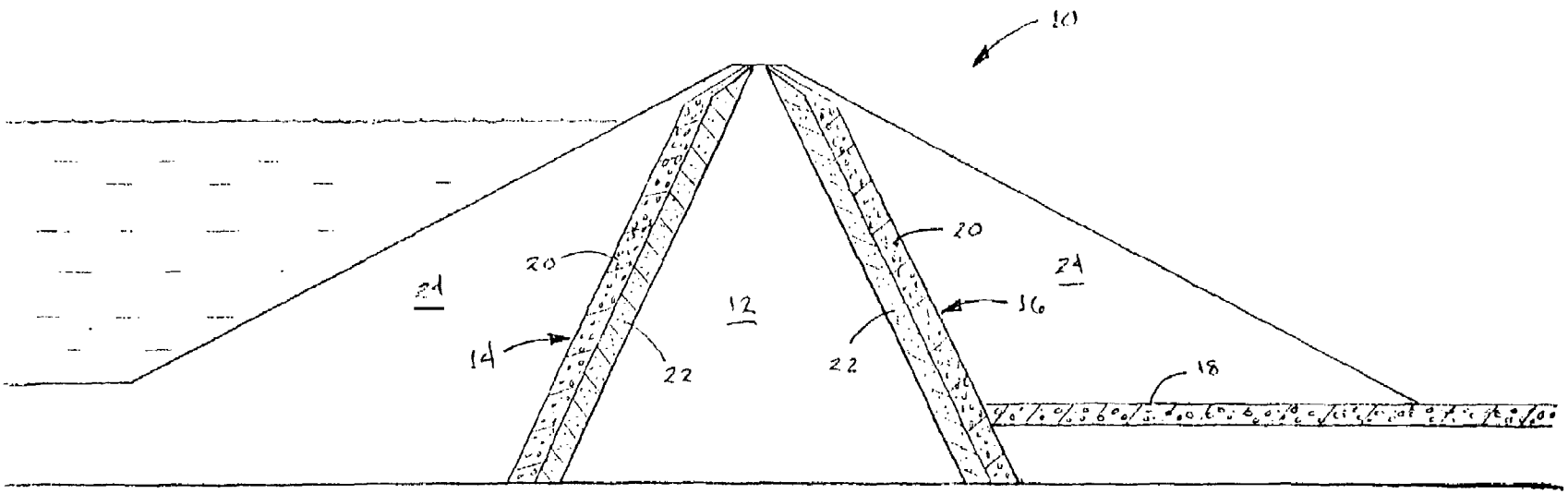
FIG. 13 is a simplified cross-sectional view of an exemplary earthfill dam, showing the structure of the filter zones that may be using the method and apparatus of the present invention.

The filter zones are thus built up in the manner of a series of strata, the fine and coarse filler materials being deposited and worked simultaneously with each pass rather than separately as in the prior art. In most instances, the surrounding portions of the dam (e.g., the berm) will be built up more or less at the same time as the filter zones, although this may not be so in all installations. Moreover, the sequential passes, as illustrated in FIGS. 9-10, may progressively shift to one side or the other (i.e., to the right or left) so that the filter zones are built up at an angle to vertical, for example, to form filter zones that are angled similar to the zones 14, 16 that are shown in FIG. 13.

It is to be recognized that various alterations, modifications, and/or additions may be introduced into the constructions and arrangements of parts described above without departing from the spirit or ambit of the present invention as defined by the appended claims.

What is claimed is:

1. A method for constructing a filter zone of an earthfill dam, said method comprising the steps of:

placing a first particulate material composed primarily of relatively coarser particles and a second particulate material composed primarily of relatively finer particles in a vehicle so that said first and second particulate materials remain segregated therein;

advancing said vehicle along a predetermined path that corresponds to horizontal cross-section of said filter zone while discharging said first and second particulate materials simultaneously from said vehicle in uncompacted flows that are convergent towards said path, so that in a single pass said first particulate material composed of relatively coarser particles and said second particulate material composed of relatively finer particles are deposited simultaneously in adjoining relationship generally on first and second sides of said path so as to form a stratum of said filter zone; and repeating the steps of advancing said vehicle along said predetermined path while discharging said particulate materials, so as to form a plurality of said strata in built-up, overlying relationship such that said first particulate material forms a coarse filter portion of said filter zone and said second particulate material forms a fine filter portion of said filter zone.

2. The method of claim 1, wherein the step of discharging said particulate materials comprises:

depositing said first and second particulate materials in elongate berms that meet along a common interface.

3. The method of claim 2, further comprising the step of:

grading said elongate berms of each said stratum prior to depositing a subsequent stratum thereon.

4. The method of claim 3, wherein the step of grading said elongate berms comprises:

at least partially compacting said particulate materials of said stratum prior to depositing said subsequent stratum thereon.

5. The method of claim 3, wherein the step of discharging said particulate materials comprises:

discharging said first and second particulate materials from an ejector body on said vehicle having a divider that maintains segregation of said particulate materials during transportation and discharge.

6. The method of claim 5, wherein the step of grading said elongate berms comprises:

grading said berms with a second vehicle that trails along said predetermined path.

7. The method of claim 6, wherein the step of grading said elongate berms further comprises:

compacting said berms with a third vehicle that trails said second vehicle along said predetermined path.

8. The method of claim 6, wherein said vehicle is an earth-moving truck having said ejector body mounted thereon.

9. The method of claim 8, wherein the step of grading said berms further comprises:

grading said berms so that said stratum has a substantially level upper surface for subsequent passage of said earth-moving truck thereover.

10. The method of claim 9, wherein said second vehicle is a dozer having a blade assembly for striking off and levelling said berms of particulate material.

11. The method of claim 10, wherein the step of grading said elongate berms further comprises:

compacting said berms with a roller compactor that trails said dozer along said predetermined path.

12. A method for constructing a filter zone of an earthfill dam, said method comprising the steps of:

placing first and second relatively coarser and relatively finer particulate materials in a truck having a load body with a longitudinal barrier that segregates said first and second particulate materials on opposite sides of said truck;

advancing said truck along a predetermined path that corresponds to a horizontal cross-section of said filter zone while ejecting said first and second particulate materials simultaneously and rearwardly from said load body in uncompacted flows that are convergent towards said path, so that in a single pass said first, relatively coarser particulate material and said second, relatively finer particulate material are deposited simultaneously in adjoining elongate berms generally on first and second sides of said path so as to form a stratum of said filter zone;

grading said elongate berms of said first and second particulate materials with a dozer that trails said truck along said predetermined path, so as to at least partially compact said particulate materials and form a generally level upper surface on said stratum; and repeating sequentially the steps of advancing said truck along said predetermined path while ejecting said particulate materials and grading said berms with said dozer trailing said truck, so as to form a plurality of said strata in overlying relationship such that said relatively coarser particulate material forms a coarse filter portion of said filter zone and said relatively finer particulate material forms a fine filter portion of said filter zone.

13. An apparatus for constructing a filter zone of an earthfill dam, said apparatus comprising:

a vehicle; and a load body mounted to said vehicle for transporting first and second relatively coarser and relatively finer particulate materials and discharging said materials therefrom, said load body comprising:

a load box having an interior for containing said particulate materials;

an ejector assembly mounted, in said load box for discharging said particulate materials therefrom, said ejector assembly comprising:

a forward bulkhead that extends generally transversely across said interior of said load box;

a divider bulkhead that extends from said forward bulkhead generally longitudinally through said interior of said load box so as to maintain segregation of said first and second particulate materials therein; and means for translating said forward bulkhead rearwardly through said load box so as to discharge said particulate materials from a rearward end thereof; and a chute assembly mounted proximate said rearward end of said load box, said chute assembly comprising:

first and second generally downwardly-directed chutes for receiving separately said first and second particulate materials that are discharged from said load box and directing said materials downwardly as said vehicle is driven forwardly so as to deposit first and second elongate berms that form a stratum of said filter zone.

14. The apparatus of claim 13, wherein said divider bulkhead comprises:

a generally planar divider wall that separates said load box into right and left compartments.

15. The apparatus of claim 14, wherein said divider wall extends substantially along a centerline of said load box so as to divide said load box into substantially equal-sized compartments.

16. The apparatus of claim 14, wherein said divider wall comprises:

an upper edge portion that extends to a level above first and second outboard edges of said load box, so that said divider wall forms a backstop that prevents material from spilling from one said compartment to the other said compartment when being loaded.

17. The apparatus of claim 14, wherein said ejector assembly further comprises:

a rearward bulkhead that is mounted to a rearward portion of said divider wall and extends generally transversely across said interior of said load box, so that when said ejector assembly is in a forward, retracted position said rearward bulkhead closes said rearward end of said load box and when said ejector assembly is translated rearwardly towards an extended position of said rearward bulkhead opens said rearward end of said load box so as to permit said particulate materials to be discharged therefrom.

18. The apparatus of claim 14, wherein said ejector assembly further comprises:

means for supporting a rearward portion of said divider bulkhead as said forward bulkhead is translated rearwardly through said load box.

19. The apparatus of claim 18, wherein said means for supporting a rearward portion of said divider bulkhead comprises:

a horizontal axis roller mounted in supporting engagement with a lower edge of said divider wall.

20. The apparatus of claim 14, wherein said chute assembly comprises:

first and second deflector portions that direct said first and second particulate materials in downward and inward directions so that said first and second elongate berms meet along a common interface.

21. The apparatus of claim 20, wherein said chute assembly further comprises:

means for substantially preventing mixing of said first and second particulate materials at said common interface between said elongate piles.

22. The apparatus of claim 21, wherein said means for preventing mixing of said first and second particulate materials comprises:

a divider plate that extends generally vertically intermediate said first and second deflector portions in substantially coplanar relationship with said divider wall of said ejector assembly.

* * * * *